US007703452B2

(12) United States Patent
Repetti, III

(10) Patent No.: US 7,703,452 B2
(45) Date of Patent: Apr. 27, 2010

(54) SKIRT

(76) Inventor: Daniel J. Repetti, III, 93 W. 29th St., Bayonne, NJ (US) 07002

( * ) Notice: Subject to any disclaimer, the term of this patent is extended or adjusted under 35 U.S.C. 154(b) by 156 days.

(21) Appl. No.: 11/657,865

(22) Filed: Jan. 25, 2007

(65) Prior Publication Data

US 2008/0178861 A1 Jul. 31, 2008

(51) Int. Cl.
*F24C 15/22* (2006.01)
*F24C 15/10* (2006.01)

(52) U.S. Cl. ..... 126/214 D; 99/447; 99/645

(58) Field of Classification Search ..... 126/214 D; 99/645, 447; 220/580
See application file for complete search history.

(56) References Cited

U.S. PATENT DOCUMENTS

| | | | | | |
|---|---|---|---|---|---|
| 227,369 | A | * | 5/1880 | Lott | 126/266 |
| 1,353,265 | A | * | 9/1920 | Oshige | 126/215 |
| 1,367,333 | A | * | 2/1921 | Truesdell | 126/215 |
| 1,592,729 | A | * | 7/1926 | Feist | 126/214 D |
| 1,622,587 | A | * | 3/1927 | Housel | 126/383.1 |
| 1,710,971 | A | * | 4/1929 | Dick | 126/376.1 |
| 1,881,606 | A | | 10/1932 | Humphreville | |
| 1,984,708 | A | * | 12/1934 | Surges | 431/356 |
| 2,003,773 | A | | 6/1935 | Gross | |
| 2,014,931 | A | * | 9/1935 | Genovar, Jr. | 126/390.1 |
| 2,030,519 | A | | 2/1936 | Hamilton | |
| 2,080,592 | A | * | 5/1937 | Zickler | 126/376.1 |
| 2,237,081 | A | * | 4/1941 | Owens | 126/25 R |
| 2,522,085 | A | * | 9/1950 | Beckemeyer et al. | 219/433 |
| 2,565,726 | A | | 8/1951 | Garrison | |
| 2,605,382 | A | * | 7/1952 | Kircher et al. | 219/433 |
| 2,797,298 | A | * | 6/1957 | Fujitani | 219/443.1 |
| 3,065,855 | A | * | 11/1962 | Edwards | 210/469 |
| 3,658,049 | A | * | 4/1972 | Gerber | 126/215 |
| 3,960,134 | A | * | 6/1976 | Scott | 126/24 |
| 4,014,315 | A | * | 3/1977 | Lagunilla | 126/275 R |
| 4,296,728 | A | * | 10/1981 | Hofstetter | 126/376.1 |
| 4,320,736 | A | * | 3/1982 | Sharon | 126/19 M |
| 4,448,186 | A | | 5/1984 | Smith | |
| 4,532,911 | A | * | 8/1985 | Orter | 126/27 |
| 4,646,717 | A | * | 3/1987 | Baggioli | 126/376.1 |
| 4,942,864 | A | | 7/1990 | Esposito | |
| 5,041,720 | A | | 8/1991 | Esposito | |
| 5,125,393 | A | * | 6/1992 | Levitin | 126/376.1 |

(Continued)

FOREIGN PATENT DOCUMENTS

DE 3402760 A * 8/1985

(Continued)

*Primary Examiner*—Kenneth B Rinehart
*Assistant Examiner*—Jorge Pereiro
(74) *Attorney, Agent, or Firm*—Ward & Olivo

(57) ABSTRACT

A device for circulating heat along a side wall of a cooking vessel, a cooking vessel comprises such device, and a method of using such device. The device can be constructed as part of the cooking vessel or can be an accessory that attaches to different sized cooking vessels via adjusting means. Specifically, the device comprises a skirt-like body extending from the side of the cooking vessel that directs heat to circulate along an underside of the body and over the side wall of the cooking vessel, thereby heating the side wall of the cooking vessel. The device can further comprise diffusers, a bottom portion with a plurality of openings, and a heat shield.

11 Claims, 4 Drawing Sheets

U.S. PATENT DOCUMENTS 5,195,500 A * 3/1993 Lerner ..... 126/29
5,315,983 A 5/1994 Law
5,373,836 A * 12/1994 Mifune et al. ..... 126/376.1
5,499,576 A * 3/1996 Grunder ..... 99/421 H
5,669,372 A 9/1997 Humphrey
5,957,123 A 9/1999 Addonizio et al.
6,095,366 A * 8/2000 Sova ..... 220/366.1
6,718,966 B1 * 4/2004 Barbour ..... 126/25 R
6,935,330 B1 8/2005 Barrero et al.

FOREIGN PATENT DOCUMENTS

DE 20002222 U1 * 9/2000
GB 2184344 A * 6/1987
JP 10192149 A * 7/1998
JP 2001041471 A * 2/2001

* cited by examiner

SKIRT

FIELD OF THE INVENTION

The present invention generally relates to the field of cooking vessels and more specifically, the present invention relates to saving heat in cooking vessels by controlling heat loss during the cooking process.

BACKGROUND OF THE INVENTION

A vast amount of energy is consumed by modern civilization, forcing nations to expend considerable resources into conserving energy. The U.S. government encourages industries to produce energy efficient appliances and awarding an Energy Star designation to appliances that exceed industry efficiency averages. Yet, energy can be also conserved utilizing simple techniques and specially configured tools.

One large source of energy usage is cooking. Typically, a conventional cooking vessel (e.g., pots, pans, casseroles, etc.) is heated from a heat source such as a stove top burner which heats the bottom of the vessel. This in turn, cooks the contents therein. This heating process is somewhat inefficient when used with a standard pot or pan, because much of the heat escapes to the sides, between the cooking vessel and the burner, and into the atmosphere. All of these factors cause energy loss and make heating the vessel difficult. To avoid some heat loss, cooking vessels are manufactured from heat-conducting materials that heat up fast and maintain heat. However, such cooking vessels become dangerous as they get extremely hot, and the problem of heat loss into the atmosphere is not minimized.

Heat-conserving accessories are also available. For example, constricting rings, which are placed on the stove top and, are widely available. The ring collects and directs around the burner heat to the vessel located above the burner, which prevents heat from escaping to the sides. These accessories, however, can become hazardous since pressure tends to build up inside of them. In addition, these accessories are inefficient because they block oxygen from the burner flame and are difficult to configure for different types of stoves.

Other heat conserving accessories, such as heat distributing plates, are also known in the art. They are generally made of a single heat-conducting material or two layers of material with a hollow inner space which traps heat. The plates are placed between the cooking vessel and the stove burner to capture the heat and distribute it along the cooking vessel's bottom surface. These plates, however, take a considerable amount of time to cool off and are often made of heavy materials that are not ideal for easy maneuverability in a kitchen.

Accordingly, a need exists for a cooking accessory which improves the heating efficiency of stove tops, allowing cooking vessels to heat faster and save energy. Additionally, a need exists for a cooking accessory which is safely operable and user friendly.

SUMMARY OF THE INVENTION

The present invention is a skirt-like device which can be attached to a cooking vessel. The device increases the vessel's ability to efficiently utilize heat emitted from a heat source by preventing heat loss into the atmosphere. Advantageously, a cooking vessel equipped with the device heats faster than cooking vessels not utilizing the device. The device also allows to use the cooking vessel at a low stove top setting to reach substantially similar temperatures as cooking vessels not using the device at high stove top setting. In addition, the device alone, or in combination with a fitted cooking vessel lid, can maintain heat and continue to cook contents within the cooking vessel even after the stove top heat source had been turned off. Thus, the device of the present invention saves time, energy, and money. The ecological benefits of the present invention should not be overlooked. Over a period of time, the present invention will minimize energy consumption, thereby aiding in the global quest for energy conservation.

Virtually everyone who cooks can benefit from this unique energy saving design, including restaurants, caterers, average families, military bases, or the like. Given the design advantages of this invention, its utility and convenience are economical and practical. The device can be safely used with most conventional stoves and heat sources, i.e., natural gas, electric, propane, or the like.

The device harnesses heat that normally would be lost in the cooking process. The cooking vessel dimensions as well as the size, shape and position of the device contribute to the safe transfer of heat from the burner to the bottom of the cooking vessel and up the sides, where it makes contact with the device, causing the heat to bank down and follow the shape of the device. The heat circulates under the device, further heating the sides of the vessel. The placement of the device in relationship to the bottom of the cooking vessel allows for the safe transference and circulation of heat into the air.

The device will preferably be a stand-alone item that can be attached and detached from a cooking vessel. However, vessels could be manufactured such that the device will be a permanent fixture. The device is preferably constructed of a durable metal alloy that will not warp during the cooking process.

One object of the present invention is to provide a cooking vessel which controls heat loss during the cooking process.

Another object of the present invention is to provide a cooking accessory which harnesses and recirculates the heat that would normally escape up the sides of the cooking vessel.

Another object of the present invention is to provide a cooking accessory which enables faster cooking with less energy expenditure than cooking without it.

Another object of the present invention is to provide a cooking accessory which saves time, energy, and money.

Another object of the present invention is to minimize energy consumption and aid in the global quest to conserve energy.

Another object of the present invention is to provide a cooking accessory that can be utilized with different sized cooking vessels.

Another object of the present invention is to provide a cooking accessory which is safe and easy to use.

In one embodiment of the present invention, a removable device is provided for circulating heat along a side wall of a cooking vessel. The device comprises a cylindrical portion for attaching the device to the side wall of the cooking vessel and a skirt-like body extending from the cylindrical portion. The device directs heat to circulate along an underside of the body and over the side wall of the cooking vessel to heat the side wall of the cooking vessel. The skirt-like body can comprise a lip portion inwardly extending from an end of the body, opposite to an end of said cylindrical portion that assists with directing heat. The device body can also comprise a plurality of diffusers to direct heat. Further, the device can comprise a bottom portion connected to an end of the body, opposite to an end of the cylindrical portion. The bottom portion is provided with a plurality of openings to allow the heat to exit the device. The removable device further comprises attachment means to attach the device to the side wall of the cooking vessel. Attachment means include, but are not limited to, clasps, buckles, bolts, screws, pins, rivets, snaps, straps, or the like. The device can further be adjusted to fit different sized cooking vessels via adjusting means known in the art. Additionally, the device can comprise safety features such as a heat shield.

In another embodiment of the present invention, a cooking vessel is provided comprising a bottom wall, a side wall, and an opening. Optionally, the cooking vessel can comprise a cover with adjustable vents to allow heat circulation within the pot. The cooking vessel further comprises a skirt-like device having a body which extends from an outer perimeter of the side wall. The device directs heat to circulate along an underside of the body and over the side wall of the cooking vessel thereby heating the side wall of the cooking vessel. As previously described, the device can comprise a lip portion, a plurality of diffusers, and a bottom portion comprising an opening that assist in directing heat flow.

BRIEF DESCRIPTION OF THE DRAWINGS

A further understanding of the present invention can be obtained by reference to preferred embodiments and corresponding alternate embodiments as set forth in the illustrations of the accompanying drawings. Although the illustrated embodiments are merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the specific methods and instrumentalities disclosed.

For a more complete understanding of the present invention, reference is now made to the following drawings in which.

DETAILED DESCRIPTION OF THE PREFERRED EMBODIMENTS

Detailed illustrative embodiments of the present invention are disclosed herein. However, techniques, systems, and operating structures in accordance with the present invention may be embodied in a wide variety of forms and modes, some of which may be quite different from those in the disclosed embodiments. Consequently, the specific structural and functional details disclosed herein are merely representative, yet in that regard, they are deemed to afford the best embodiments for the purposes of disclosure and to provide a basis for the claims herein, which define the scope of the present invention. The following presents a detailed description of preferred embodiments (as well as some alternative embodiments) of the present invention.

Figure 1A:
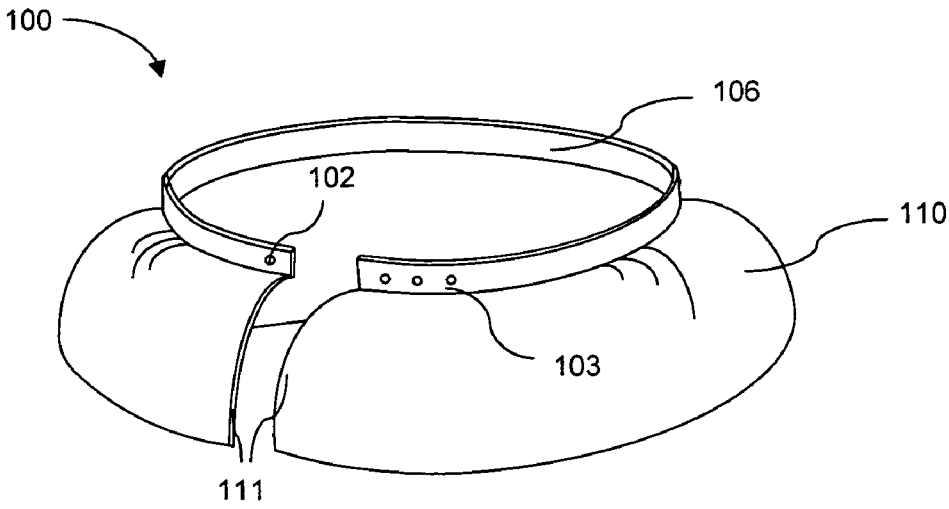
FIGS. 1A, 1B and 1C illustrate a removable and adjustable device for circulating heat in accordance with the present invention.
Figure 1B:
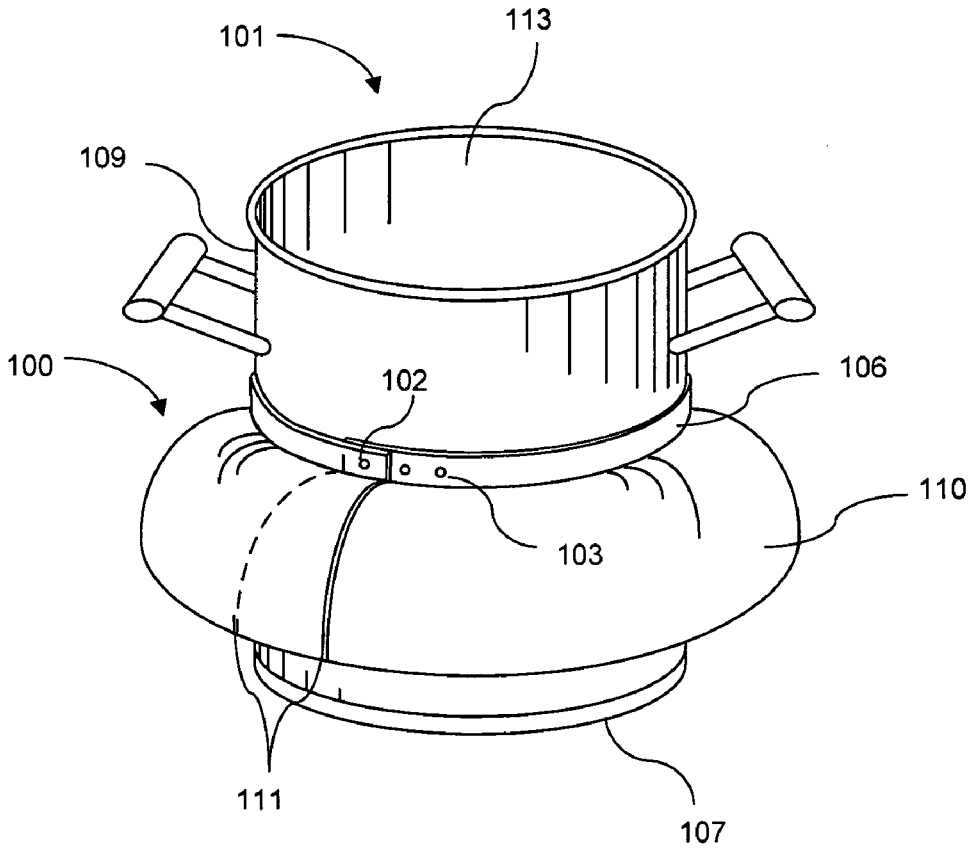
Figure 1C:
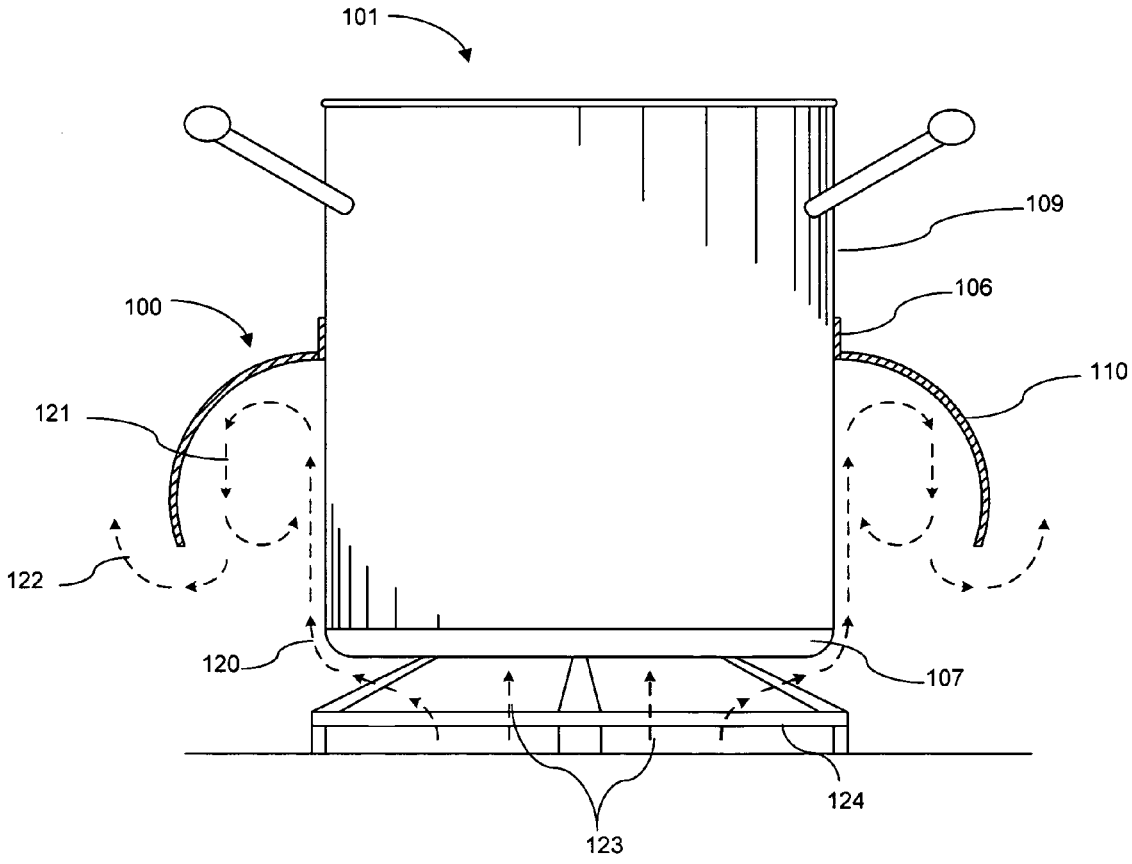

Referring to the drawings, wherein like numerals indicate like elements throughout, FIGS. 1A, 1B, and 1C show an adjustable and removable device 100 having cylindrical portion 106 and a skirt-like body 110. Of course, the device can be of any other shape capable of circulating heat as later described. Device 100 may be cut along walls 111 to allow the device to be assembled on and removed from a cooking vessel. Any other ways of assembling skirt 100 on vessel 101 may be used without departing from the scope of the present invention. For example, the device can comprise two or more substantially equivalent body sections that are fitted and secured around cooking vessel 101.

Cylindrical portion 106 also comprises attachment means 102 to attach device 100 to side wall 109 of cooking vessel 101. Further, cylindrical portion 106 can comprise adjusting means 103 to adjust cylindrical portion 106 and thereby device 100 to fit different sized cooking vessels. As shown in FIG. 1B, device 100 is wrapped around cooking vessel 101 and positioned at a desired location. Then, device 100 is adjusted to hug the exterior surface of side wall 109 by bringing walls 111 together and overlapping the device sections. When device 100 is tightly position on side wall 109, it is secured in place via attachment means 102. Attachment means 102 may include, but are not limited to, a clasp, buckle, bolt, screw, pin, rivet, snap, strap, or the like. For example, multiple pins 103 are illustrated on one side of cylindrical portion 106. The selected pin is determined by the size of the diameter of the cooking vessel. Optionally, pins 103 can each be labeled to indicate the corresponding pot diameter.

In use, following the placement of device 100 onto cooking vessel 101, cooking vessel 101 with contents to be cooked is placed on or in a close upward proximity to a heat source 124 (e.g., a burner), as illustrated in FIG. 1C. Heat from energy source 124 rises along direction 123 and heats up the bottom wall 107 of cooking vessel 101. Additionally, heat rises, runs up side wall 109 of cooking vessel 101 along direction 120, and is caught underneath device 100. Under device 100, the heat banks down by the upper section of body 110, follows the shape of the body's underside, and circulates along direction 121. As the heat circulates under device 100, it continuously heats side wall 109 of cooking vessel 101. As such, cooking vessel 101 is exposed to more heat than if device 100 was not present, thereby heating the contents inside cooking vessel 101 faster. Advantageously, as the heat circulates under device 100, it transfers heat onto cooking vessel wall 109, and exits as more heat enters the device along direction 122. This process allows more area of cooking vessel 101 to be heated, more than doubling the area heated in conventional cookware, while using less energy.

Preferably, the device will be manufactured from a durable metal alloy or any other like material known in the art that will not warp under exposure to operational heat. Some other desirable material properties include smoothness, low heat conductance, light weight, and high melting point. Furthermore, the exterior surface of body 110 can be coated or be cased in a heat shield. The heat shield will keep the outside surface of the device relatively cool and safe to the touch.

Device 100 is preferably positioned with enough distance from bottom wall 107 of cooking vessel 101 to allow safe operation. As such, heat is not completely restrained under device 100 but can instead safely escape into to the atmosphere after it is recirculated. Additionally, the shape of the device body 110 should provide a smooth path for the heat to enter device 100, circulate therein, and exit. This can be achieved most preferably by a smooth and rounded body shape. Also, the distance between the side portion of device 100 and side wall 109 of cooking vessel 101 should be large enough to allow heat circulation along direction 121. For example, a cooking vessel 10" in height and 8-9" in diameter can be fitted most preferably with a device that is 3½" tall and 2" wide. The device can be placed 4½" from the top of cooking vessel 101, leaving 2" clearance on the bottom for heat to escape. As such, the device is large enough to allow heat to circulate within and escape to the atmosphere.

Figure 2A:
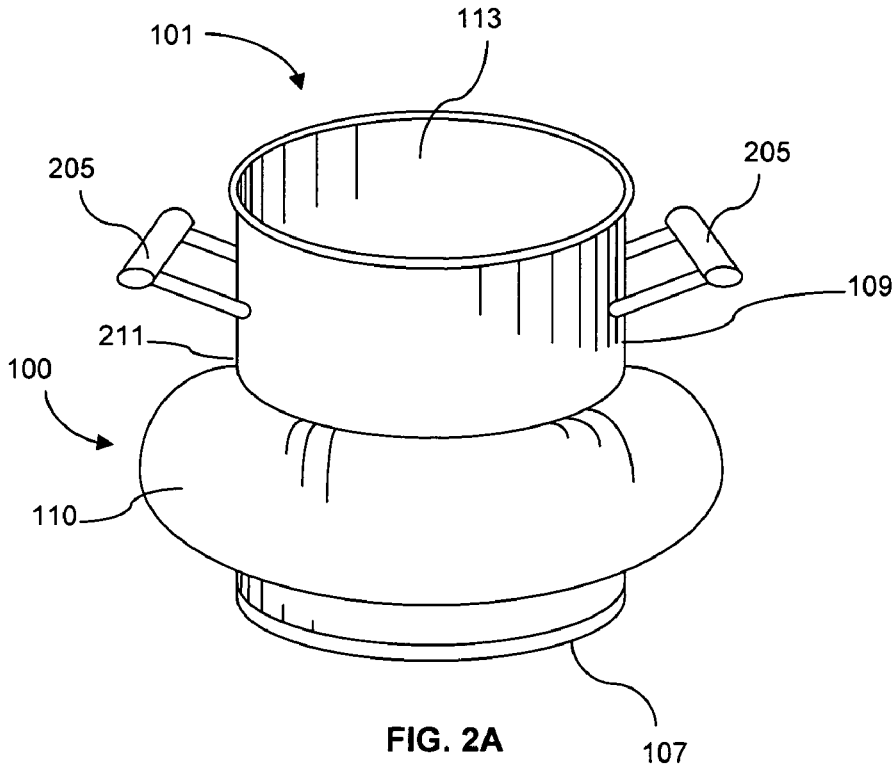
FIGS. 2A and 2B illustrate a cooking vessel with a device for circulating heat in accordance with the present invention.
Figure 2B:
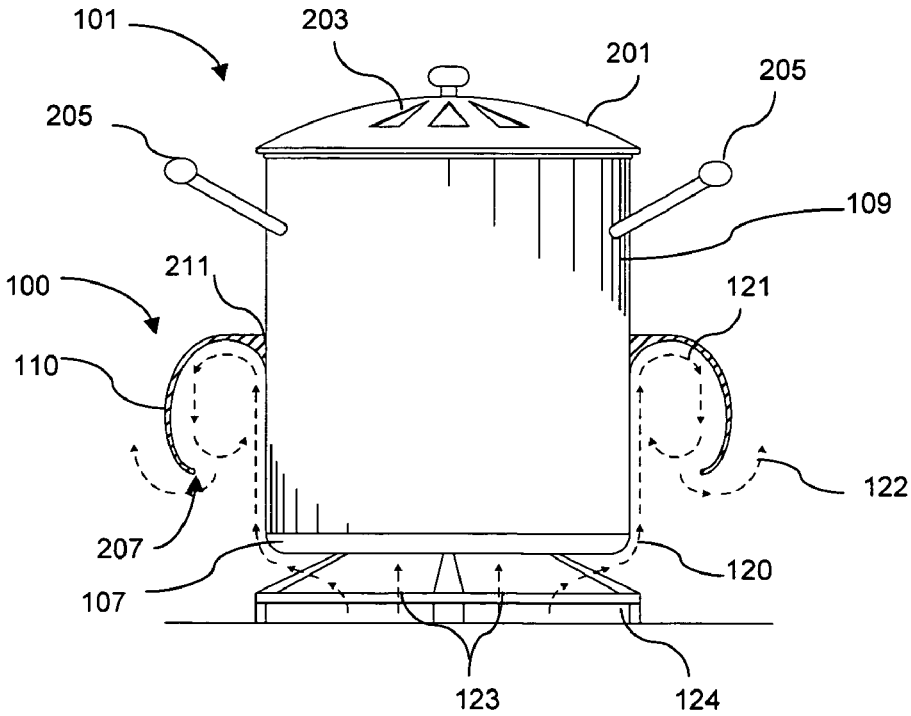

Additionally, cooking vessels can be offered pre-manufactured with the device for circulating heat. FIGS. 2A and 2B illustrate cooking vessel 101 having a body comprising bottom wall 107, side wall 109, and opening 113. Device 100, in accordance with the present invention, comprises body 110 connected to an outer perimeter of side wall 109 at connection 211. Device 100 can be welded onto side wall 109 of cooking vessel 101 or can be mounted via attachment means such as screws, bolts, pins, or the like. As illustrated, body 110 can further comprises lip portion 207 which adds curvature to body 110, thus assisting with directing heat circulation.

Cooking vessel 101 could also optionally contain insulated handles 205 that extend from side wall 109 of cooking vessel 101. Further, a cover 201 with adjustable vents 203 may optionally be provided to close cooking vessel opening 113. This would allow for more heat to be conserved within cooking vessel 101 while vents 203 will help to prevent contents therein to boil over. Also, cover 201 will assist device 100 to maintain heat and continue cook contents inside cooking vessel 101 after the stove top heat source had been turned off. Cover 201 can also comprise a sealing mechanism to securely seal it on cooking vessel.

Figure 3:
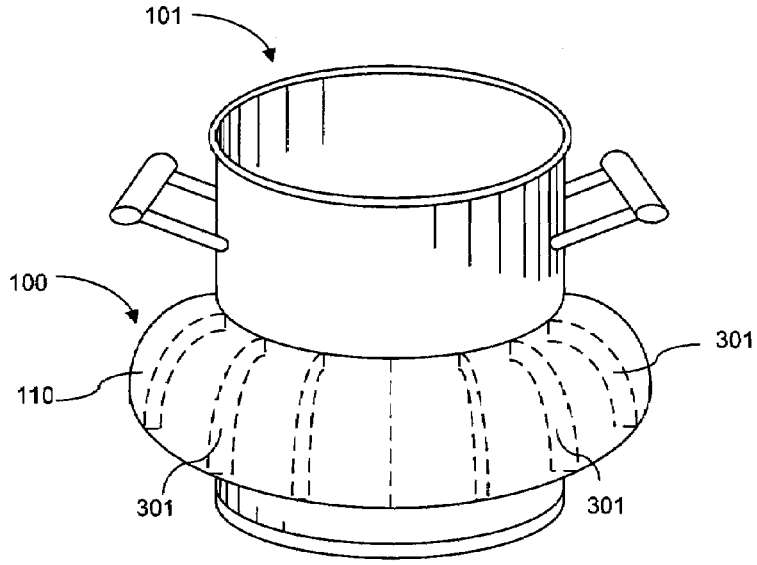
FIG. 3 illustrates a perspective view of a cooking vessel with a device comprising a plurality of diffusers for circulating heat and for strength of design in accordance with the present invention.

FIG. 3 illustrates cooking vessel 101 wherein device 100 comprises plurality of diffusers 301 extending from the interior surface of body 110. Each pair of diffusers 301 creates a path therebetween for the heat to follow, thereby assisting heat circulation. Diffusers 301 also add additional strength to device 100 adding to its ability not to bend or warp under heat. Other means that assist heat circulation can be utilized without departing from the scope of the present invention.

Figure 4A:
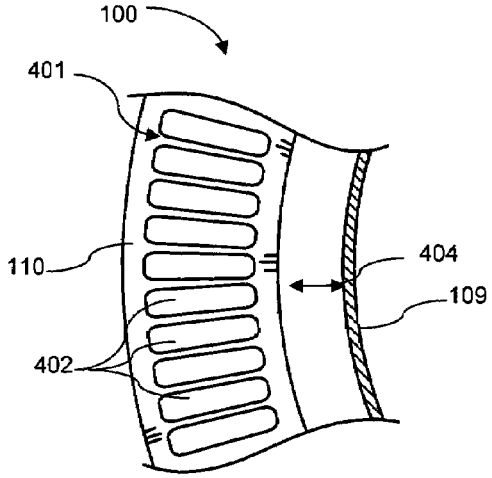
FIGS. 4A and 4B illustrate a perspective view of a cooking vessel with a device comprising a bottom portion with a plurality of openings for circulating heat in accordance with the present invention.
Figure 4B:
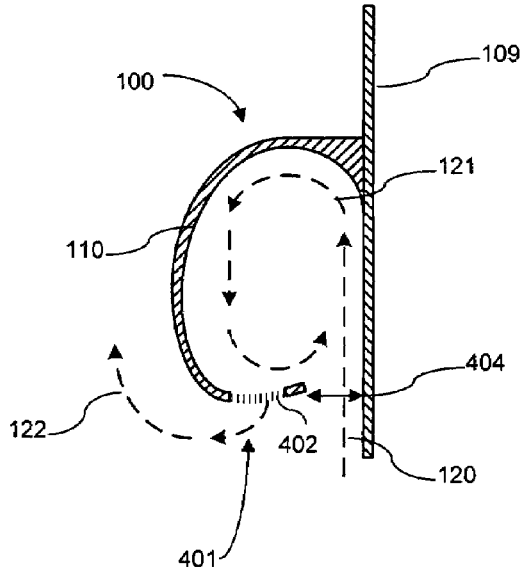

Device 100 can also comprise bottom portion 401 with a plurality of openings 402 as illustrated in FIGS. 4A and 4B. Specifically, FIG. 4A shows a sectional bottom pane view and FIG. 4B shows a sectional side pane view of cooking vessel wall 109 and device 100. Specifically, bottom portion 401 extends from the end of body 110 towards side wall 109 leaving space 404 therebetween. Furthermore, plurality of openings 402 are provided through bottom portion 401. In use, heat will enter the interior of device 100 though space 404 along direction 120. The heat will circulate within, along direction 121, while heating side wall 109 of cooking vessel 101. After transferring heat, remaining heat will exit device 100 through the plurality of openings 402 along direction 122. The bottom portion will assist heat circulation while allowing remaining heat to safely exit device 100.

From the foregoing description of the preferred embodiments, which have been set forth in considerable detail for the purpose of making a complete disclosure of the present invention, it can be seen that the present invention comprises a device for circulating heat along a side wall of a cooking vessel. The device can be permanently attached to the cooking vessel or it can be removable and adjustable. Specifically, the device includes a skirt-like body extending from a side wall of a cooking vessel. The device can further comprise features such as a lip portion, diffusers, bottom portion with a plurality of openings, and heat shield. It will be appreciated by those skilled in the art that changes can be made to the embodiments described above without departing from the broad inventive concept thereof. It is understood, therefore, that this invention is not limited to the particular embodiments disclosed, but it is intended to cover all modifications that are within the scope and spirit of the invention as defined by the appended claims.

What is claimed is:

1. A device, for attachment to a side wall of a cooking vessel, comprising:

a cylindrical element mounted to or attached to said side wall of said cooking vessel at a first elevation above a bottom end portion of said cooking vessel; and a body element extending from said cylindrical element, wherein said body element is attached to or secured to said cylindrical element, and further wherein said body element extends about a periphery of said cooking vessel and downwardly to a second elevation above said bottom end portion of said cooking vessel;

wherein said body element further comprises a first end portion attached to or secured to said cylindrical element and a second end portion which is located at a distance from said side wall of said cooking vessel and at said second elevation above said bottom end portion of said cooking vessel, wherein said body element has a curved cross section shaped to extend from said first end portion, away from said side wall and downwardly to said second end portion;

wherein said body element further comprises a bottom portion connected to said second end portion; and wherein said bottom portion comprises a plurality of openings.

2. A device according to claim 1, wherein said body element further comprises, at said second end portion, a lip portion which extends from said second end portion in a direction downwardly and towards said side wall of said cooking vessel.

3. A device according to claim 1, wherein said body element further comprises a plurality of diffusers.

4. A device according to claim 1, wherein said cylindrical element comprises an attachment means for attaching or securing said device to said side wall of said cooking vessel.

5. A device according to claim 4, wherein said attachment means comprises at least one selected from a group consisting of a clasp, a buckle, a bolt, a screw, a pin, a rivet, a snap, and a strap.

6. A device according to claim 1, further comprising an adjusting means to adjust said cylindrical element to fit differently sized cooking vessels.

7. A cooking vessel comprising:

a bottom end portion of said cooking vessel a side wall of said cooking vessel, and an opening at a top end portion of said cooking vessel;

a cylindrical element, wherein said cylindrical element is integrated to said side wall of said cooking vessel at a first elevation above said bottom end portion of said cooking vessel; and a body element extending from said cylindrical element, wherein said body element is attached to or secured to said cylindrical element, and further wherein said body element extends about a periphery of said cooking vessel and downwardly to a second elevation above said bottom end portion of said cooking vessel;

wherein said body element further comprises a first end portion attached to or secured to said cylindrical element and a second end portion which is located at a distance from said side wall of said cooking vessel and at said second elevation above said bottom end portion of said cooking vessel, wherein said body element has, a curved cross section shaped to extend from said first end portion, away from said side wall and downwardly to said second end portion; and wherein said body element further comprise a bottom portion connected to said second end portion, and wherein said bottom portion comprises a plurality of openings.

8. A cooking vessel according to claim 7, wherein said body element further comprises, at said second end portion, a lip portion which extends from said second end portion in a direction downwardly and towards said side wall of said cooking vessel.

9. A cooking vessel according to claim 7, further comprising a cover for covering said opening at a top end portion of said cooking vessel.

10. A cooking vessel according to claim 9, wherein said cover comprises a plurality of vents.

11. A cooking vessel according to claim 10, wherein said body element further comprises a plurality of diffusers.

* * * * *